US010513135B1

(12) United States Patent
Gessner

(10) Patent No.: US 10,513,135 B1
(45) Date of Patent: Dec. 24, 2019

(54) STAMPING TOOL ACCESSORY AND STAMPING TOOL ASSEMBLY INCLUDING THE SAME

(71) Applicant: Elizabeth A. Gessner, Columbus, OH (US)

(72) Inventor: Elizabeth A. Gessner, Columbus, OH (US)

( * ) Notice: Subject to any disclaimer, the term of this patent is extended or adjusted under 35 U.S.C. 154(b) by 0 days.

(21) Appl. No.: 16/442,421

(22) Filed: Jun. 14, 2019

Related U.S. Application Data

(60) Provisional application No. 62/685,863, filed on Jun. 15, 2018.

(51) Int. Cl.
*B41K 3/62* (2006.01)
*B41K 3/44* (2006.01)

(52) U.S. Cl.
CPC . *B41K 3/44* (2013.01); *B41K 3/62* (2013.01)

(58) Field of Classification Search
CPC ... B41K 3/44; B41K 3/46; B41K 3/62; B41K 3/02
USPC ..... 101/327, 333, 474; 33/622, 623
See application file for complete search history.

(56) References Cited

U.S. PATENT DOCUMENTS 4,070,967 A * 1/1978 Schlau ..... B41K 3/04 101/301
5,402,718 A 4/1995 Rigodiat
6,916,584 B2 7/2005 Sreenivasan et al.
7,060,402 B2 6/2006 Choi et al.
7,077,992 B2 7/2006 Sreenivasan et al.
9,776,443 B1 10/2017 Myska
2001/0035886 A1 11/2001 Bradshaw et al.
2004/0124566 A1 7/2004 Sreenivasan et al.
2010/0175526 A1 7/2010 Nelson et al.
2013/0092039 A1* 4/2013 Shainwald ..... B41J 27/04 101/333
2018/0154684 A1 6/2018 Riegler et al.

OTHER PUBLICATIONS

"Circle Spin & Trim by We R Memory Keepers" YouTube Video, YouTube Website, Web page <https://www.youtube.com/watch?v=H2slWGR7llk>, 3 pages, published on Jul. 23, 2018, retrieved from YouTube.com on Jul. 15, 2019.

(Continued)

*Primary Examiner* — Leslie J Evanisko
(74) *Attorney, Agent, or Firm* — The Law Office of Patrick F. O'Reilly, III, LLC

(57) ABSTRACT

A stamping tool accessory is disclosed herein. The stamping tool accessory includes a base configured to be removably attached to a base portion of a stamping platform; and a turntable rotatable relative to the base, the turntable configured to receive a substrate on which a stamp is to be applied. At least one of the base and the turntable includes turntable positioning indicia configured to indicate generally equally spaced-apart rotational positions of the turntable for stamping multiple images in a generally circular pattern. A stamping tool assembly that includes a stamping platform and the stamping tool accessory is also disclosed herein.

20 Claims, 13 Drawing Sheets

(56) References Cited

OTHER PUBLICATIONS

"How to Make a Circle of Circles Using Inkscape" YouTube Video, YouTube Website, Web page <https://www.youtube.com/watch?v=3EoUu0KrZZ0>, 2 pages, published on Dec. 28, 2016, retrieved from YouTube.com on Jul. 15, 2019.
"Introducing the Wreath Builder System" YouTube Video, YouTube Website, Web page <https://www.youtube.com/watch?v=LRWUI0XuSJM>, 3 pages, published on Feb. 22, 2018, retrieved from YouTube.com on Jul. 15, 2019.
"Triangle Turnabout Stamp by Concord & 9th" YouTube Video, YouTube Website, Web page <https://www.youtube.com/watch?v=NVszM9zz0b8>, 2 pages, published on Apr. 7, 2017, retrieved from YouTube.com on Jul. 15, 2019.
"The hexagon Design template | Marianne Design Stamp Master | Cardmaking" YouTube Video, YouTube Website, Web page <https://www.youtube.com/watch?v=tFbUd_UcZQI>, 2 pages, published on Dec. 23, 2016, retrieved from YouTube.com on Jul. 15, 2019.
"Tim Holtz Stamping Platform—Creativation—CHA 2017" YouTube Video, YouTube Website, Web page <https://www.youtube.com/watch?v=WykeFdGI4W0>, 3 pages, published on Jan. 21, 2017, retrieved from YouTube.com on Jul. 15, 2019.
"MISTI Templates", My C.A.S.E. Studies by Maureen Wong—Blog, Web page <http://mycasestudies.blogspot.com/2015/02/misti-templates.html>, 10 pages, dated Feb. 3, 2015, retrieved from YouTube.com on Jul. 15, 2019.

* cited by examiner

Detail "A"

Detail "B"

Detail "C"

STAMPING TOOL ACCESSORY AND STAMPING TOOL ASSEMBLY INCLUDING THE SAME

CROSS-REFERENCE TO RELATED APPLICATIONS

This patent application claims priority to, and incorporates by reference in its entirety, U.S. Provisional Patent Application No. 62/685,863, entitled "Paper Craft Tool that allows circular stamping of images", filed on Jun. 15, 2018.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a stamping tool accessory and a stamping tool assembly that includes the stamping tool accessory. More particularly, the invention relates to a stamping tool accessory for stamping multiple images in a generally circular pattern that may be used in conjunction with a stamping platform.

2. Background

Paper crafting with stamps and ink has become a popular hobby. Clear polymer and rubber stamps can be used to create greeting cards, scrapbook pages, home decorations, and gifts.

Improved tools and methods of craft stamping are frequently introduced. Hinged stamp press tools developed for home paper crafters and hobbyists significantly improve the accuracy and quality of the images produced with craft stamps. The stamp presses also provide the ability to stamp an image repeatedly in an exact location.

The stamp presses are hinged tools that open like a book. The top cover of the tool is made of clear plastic. The polymer craft stamps will stick to the inside of the clear plastic cover. The bottom sections of the tools have alignment markings and rectangular edge guides that allow cardstock to be held securely in the desired position. The user can align the stamp on the lid, and cardstock in the base of the stamp press, apply ink on the stamp, close the front cover, and the image will be stamped on the cardstock. Because the stamp and cardstock are held securely, if the image was unsatisfactory, it can be re-stamped in the identical location as the first stamping.

Stamp presses also allow the cardstock to be positioned in multiple locations while the stamp remains in the same position on the clear plastic cover. Moving the cardstock in the base can produce interesting repetitions and patterns.

Cardstock can easily be turned 90 degrees or moved up and down in a stepped manner using the stamp press edge guides to help hold the cardstock in the desired location.

Although stamp presses provide precise stamping and the cardstock can be repositioned, creating a circular pattern is difficult. Usually pencil marks are drawn on the cardstock to show the center point of the circle, and rays or tick marks can be drawn to provide guides for stamp locations around a circle.

There have recently been some products released that allow stampers to produce 4-part and 8-part stamped image designs.

"Turnabout Stamps" make 4 part designs. The stamps remain stationary on the lid of the stamping tool. Cardstock that will be stamped on is taped in the center of a square sheet of paper that that serves as a square base for the process. The square can be rotated a quarter turn after each stamping and the design will be stamped at four 90 degree intervals within a circle.

Another stamping tool is a wreath builder template. The template is a piece of plastic with an 8-pointed star cut out of the center. The cardstock can be aligned with each point of the star allowing a design to be stamped every 45 degrees, 8 times around a circle.

Although, these aforedescribed conventional stamping tools have numerous limitations and drawbacks, such as being unable to produce a large variety of different circular stamping patterns.

Therefore, what is needed is a stamping tool accessory that is capable of greatly facilitating the stamping of multiple images in a generally circular pattern. Moreover, a stamping tool accessory is needed that can be used to create a myriad of different stamping patterns. Furthermore, there is a need for a stamping tool assembly that utilizes the stamping tool accessory for significantly enhancing the functionality of stamping platforms.

BRIEF SUMMARY OF EMBODIMENTS OF THE INVENTION

Accordingly, the present invention is directed to a stamping tool accessory and stamping tool assembly including the same that substantially obviates one or more problems resulting from the limitations and deficiencies of the related art.

In accordance with one or more embodiments of the present invention, there is provided a stamping tool accessory that includes a base configured to be removably attached to a base portion of a stamping platform; and a turntable rotatable relative to the base, the turntable configured to receive a substrate on which a stamp is to be applied. In these one or more embodiments, at least one of the base and the turntable comprises turntable positioning indicia configured to indicate generally equally spaced-apart rotational positions of the turntable for stamping multiple images in a generally circular pattern.

In a further embodiment of the present invention, the base forms a circular recess for accommodating the turntable such that a top surface of the turntable is generally flush with a top surface of the base.

In yet a further embodiment, the turntable rests on a top surface of the base such that the turntable protrudes slightly above the top surface of the base.

In still a further embodiment, the turntable positioning indicia are printed or inscribed on a top surface of the base adjacent to the outer periphery of the turntable, the turntable positioning indicia comprising a plurality of sets of arcuate segment markings generally equally spaced about the outer periphery of the turntable such that a 360 degree circle is divided into a plurality of generally equal arcuate sections.

In yet a further embodiment, at least some of the plurality of sets of arcuate segment markings comprise numbers, letters, or other symbols for designating the generally equally spaced-apart rotational positions of the turntable.

In still a further embodiment, the turntable positioning indicia further comprise tick marks for allowing a user to rotate the turntable to custom degree positions that lie in-between the arcuate segment markings.

In yet a further embodiment, the top surface of the base further comprises a start mark or zero mark printed or inscribed thereon for indicating an initial rotational position of the turntable.

In still a further embodiment, the turntable comprises a gripping tab for facilitating a rotation of the turntable by a user.

In yet a further embodiment, the turntable comprises a positional marking printed or inscribed thereon, the positional marking configured to be generally aligned with successive marks of the turntable positioning indicia as the turntable is rotated by a user to the generally equally spaced-apart rotational positions.

In still a further embodiment, the turntable comprises a horizontal axis and vertical axis printed or inscribed thereon, the intersection of the horizontal axis and vertical axis defining a central origin at a center point of the turntable.

In yet a further embodiment, the turntable comprises a plurality of circumferential markings, the circumferential markings comprising a plurality of concentric circles with varying diameters, the circumferential markings facilitating an alignment of stamps in varying diametrical locations.

In still a further embodiment, the turntable comprises a plurality of radial markings, the radial markings comprising a plurality of rays emanating a center point of the turntable, the radial markings facilitating an alignment of stamps along radii of the turntable.

In yet a further embodiment, the turntable comprises a plurality of horizontal and vertical substrate positioning lines printed or inscribed thereon, the plurality of horizontal and vertical substrate positioning lines configured to facilitate a placement of the substrate on the turntable by a user.

In accordance with one or more other embodiments of the present invention, there is provided a stamping tool assembly that includes a stamping platform and a stamping tool accessory. The stamping platform includes a base portion configured to receive a substrate on which a stamp is to be applied; and a cover portion hingedly coupled to the base portion, the cover portion configured to accommodate the stamp removably attached thereto. The stamping tool accessory includes a base configured to be removably attached to the base portion of the stamping platform; and a turntable rotatable relative to the base, the turntable configured to receive the substrate on which the stamp is to be applied. In these one or more embodiments, at least one of the base and the turntable comprises turntable positioning indicia configured to indicate generally equally spaced-apart rotational positions of the turntable for stamping multiple images in a generally circular pattern.

In a further embodiment of the present invention, the turntable positioning indicia are printed or inscribed on a top surface of the base adjacent to the outer periphery of the turntable, the turntable positioning indicia comprising a plurality of sets of arcuate segment markings generally equally spaced about the outer periphery of the turntable such that a 360 degree circle is divided into a plurality of generally equal arcuate sections.

In yet a further embodiment, at least some of the plurality of sets of arcuate segment markings comprise numbers, letters, or other symbols for designating the equally spaced-apart rotational positions of the turntable.

In still a further embodiment, the top surface of the base further comprises a start mark or zero mark printed or inscribed thereon for indicating an initial rotational position of the turntable.

In yet a further embodiment, the turntable comprises a gripping tab for facilitating a rotation of the turntable by a user.

In still a further embodiment, the turntable comprises a plurality of circumferential markings, the circumferential markings comprising a plurality of concentric circles with varying diameters, the circumferential markings facilitating an alignment of stamps in varying diametrical locations.

In yet a further embodiment, the turntable comprises a plurality of radial markings, the radial markings comprising a plurality of rays emanating a center point of the turntable, the radial markings facilitating an alignment of stamps along radii of the turntable.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
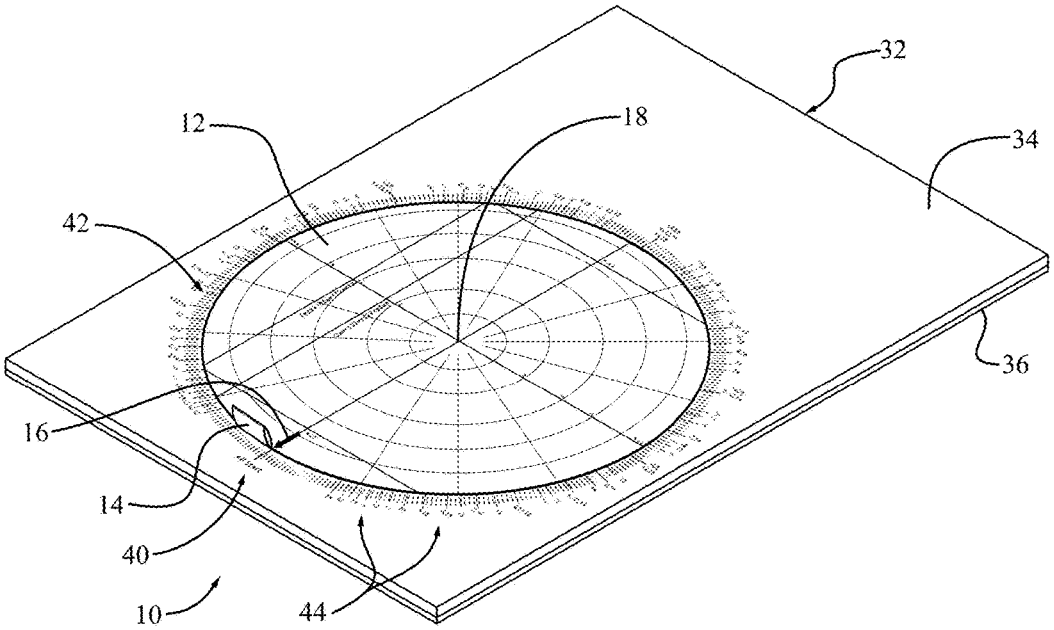
FIG. 1 is a top-side perspective view of a stamping tool accessory, according to an illustrative embodiment of the invention.

An illustrative embodiment of a stamping tool accessory is seen generally at 10 in FIGS. 1-8. In this illustrative embodiment, referring initially to FIGS. 1 and 8, the stamping tool accessory 10 generally comprises a base 32 configured to be removably attached to a base portion of a stamping platform 48, 58 (see e.g., FIGS. 9-12); and a turntable 12 rotatable relative to the base 32, the turntable 12 configured to receive a substrate (e.g., cardstock 74 in FIGS. 13-15) on which a stamp 78 is to be applied. In the illustrative embodiment, at least one of the base 32 and the turntable 12 comprises turntable positioning indicia 42, 44 configured to indicate generally equally spaced-apart rotational positions of the turntable 12 for stamping multiple images in a generally circular pattern (e.g., the stamped images of the circular patterns depicted in FIGS. 22-25).

Figure 8:
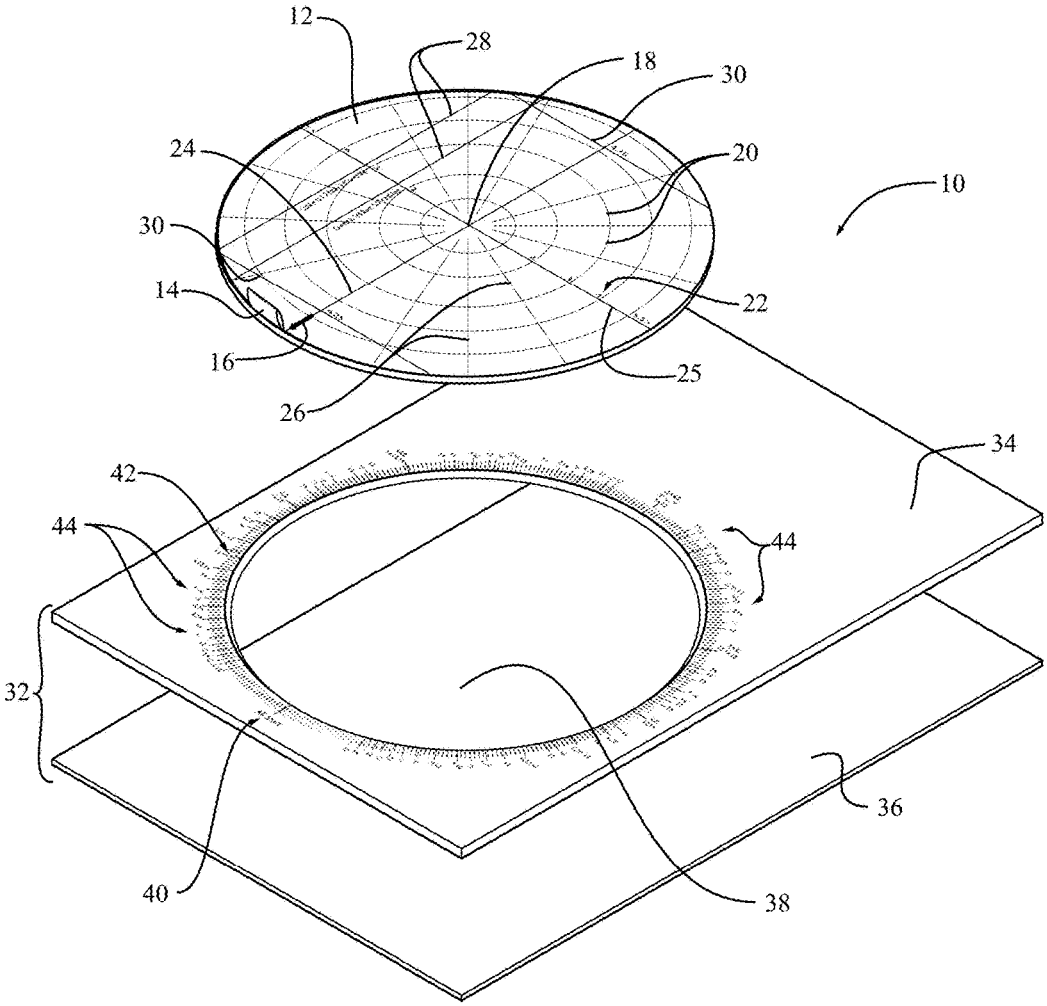
FIG. 8 is an exploded perspective view of the stamping tool accessory of FIG. 1.

In the illustrative embodiment, the stamping tool accessory 10 is in the form of a paper crafting tool for stamping multiple images in equally spaced circular patterns. In the illustrative embodiment, the stamping tool accessory 10 may be approximately one-quarter (¼) inch thick, and be made of flat printable material with a foam interior layer. As shown in FIGS. 1 and 8, the stamping tool accessory 10 may have a rectangular base or frame 32 with a rotatable center turntable 12. Markings or indicia 42, 44 allow the turntable 12 to be rotated to specific markings 42, 44 that divide the 360 degrees of a circle into equal segments. Advantageously, the markings 42, 44 allow designs to be stamped in many different numbers of spaced segments. For example, the illustrative embodiment of the stamping tool accessory 10 has segment markings 44 that allow from two (2) to eighteen (18) equally spaced stamp designs by rotating the turntable 12 to the corresponding markings 44.

Figure 2:
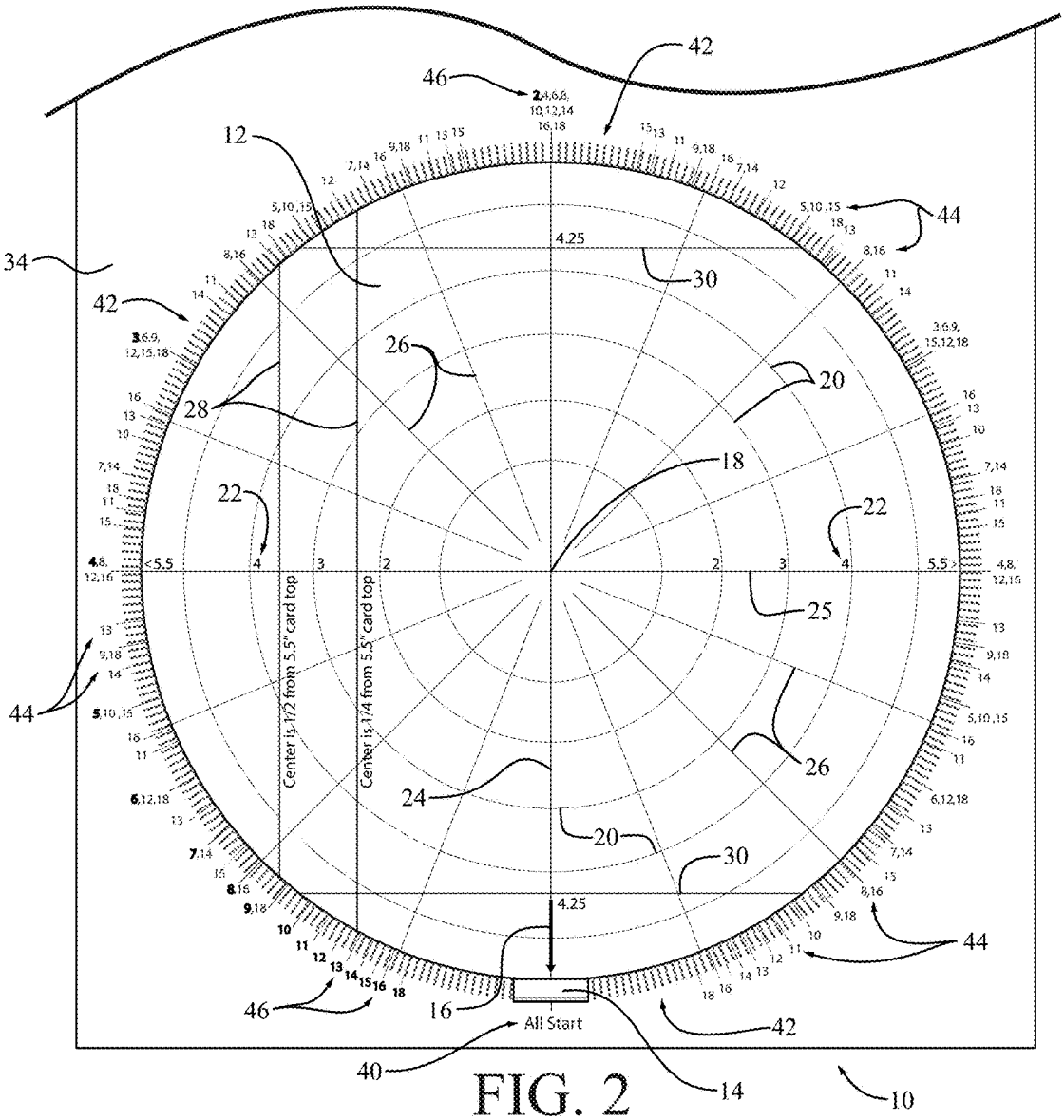
FIG. 2 is a partial, enlarged top plan view of the stamping tool accessory of FIG. 1.
Figure 3:
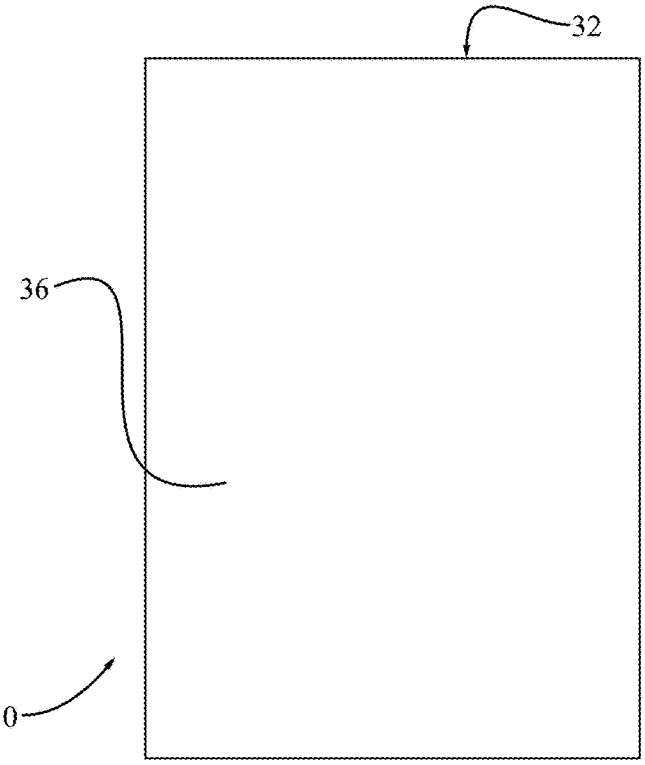
FIG. 3 is a bottom plan view of the stamping tool accessory of FIG. 1.
Figure 4:
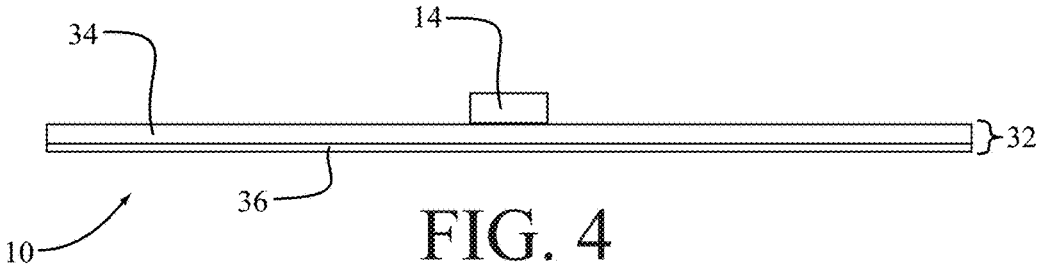
FIG. 4 is a first end elevational view of the stamping tool accessory of FIG. 1.
Figure 5:
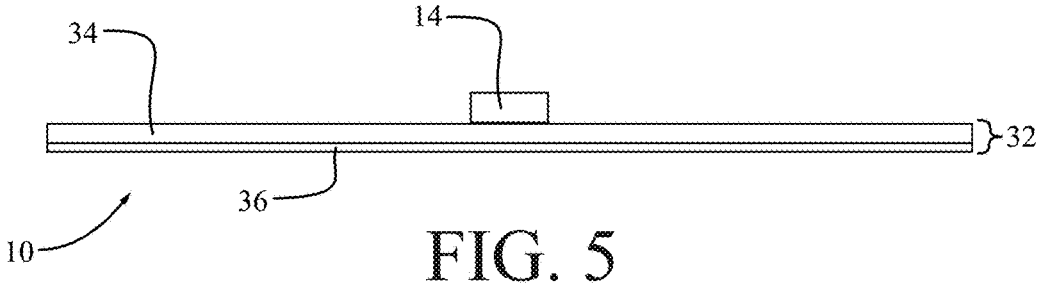
FIG. 5 is a second end elevational view of the stamping tool accessory of FIG. 1.
Figure 6:
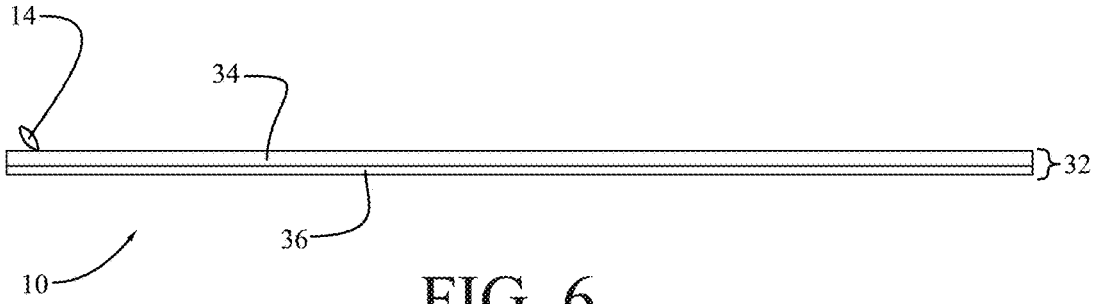
FIG. 6 is a first side elevational view of the stamping tool accessory of FIG. 1.
Figure 7:
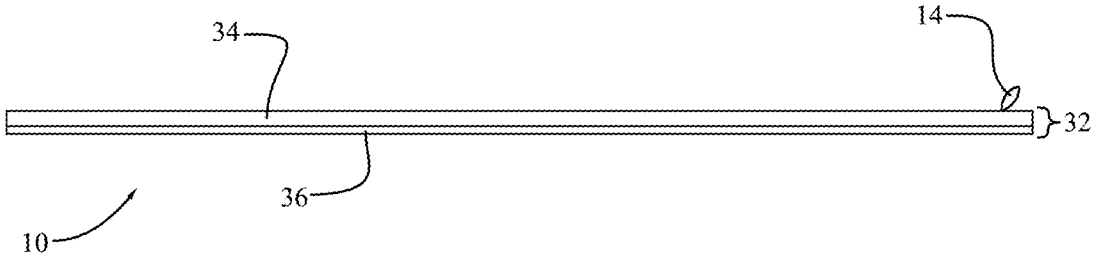
FIG. 7 is a second side elevational view of the stamping tool accessory of FIG. 1.

In the illustrative embodiment, the turntable positioning indicia (e.g., segment markings 44) are printed or inscribed on a top surface of the base 32 adjacent to the outer periphery of the turntable 12 (see e.g., FIG. 2). The turntable positioning indicia 44 comprises a plurality of sets of arcuate segment markings generally equally spaced about the outer periphery of the turntable 12 such that a 360 degree circle is divided into a plurality of generally equal arcuate sections. In the illustrative embodiment, the plurality of sets of arcuate segment markings 44 comprise numbers (see FIG. 2). Alternatively, the segment markings may comprises letters or other symbols for designating the generally equally spaced-apart rotational positions of the turntable 12.

Figure 15:
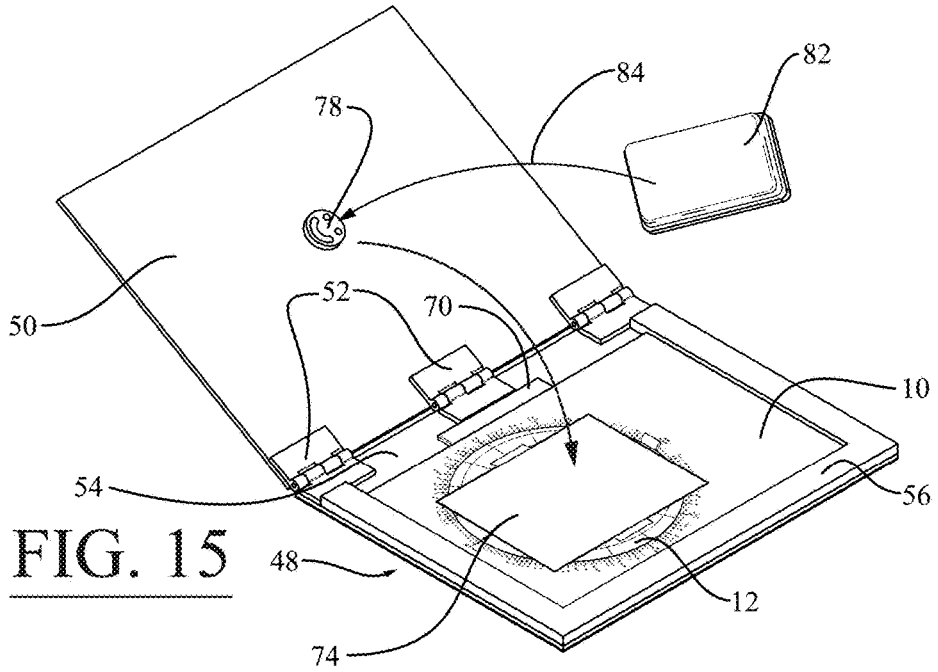
FIG. 15 is a perspective view illustrating the manner in which ink is applied to the stamp on the cover portion of the stamping platform.
Figure 16:
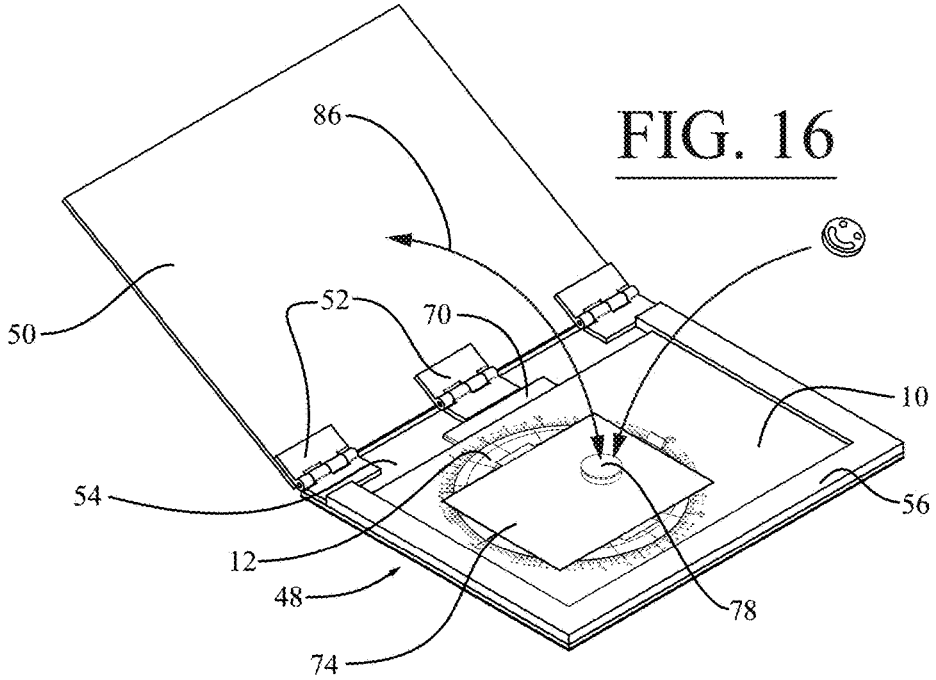
FIG. 16 is a perspective view illustrating the manner in which the stamp is applied to the cardstock in the first location using the stamping platform.
Figure 18:
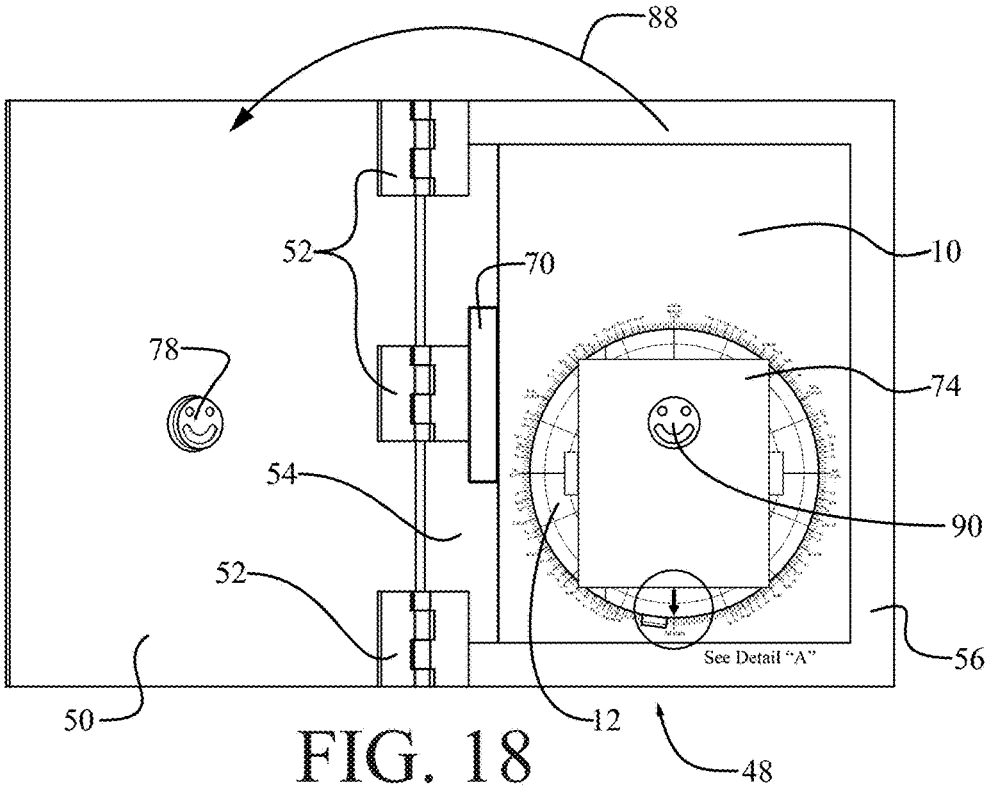
FIG. 18 is a top plan view illustrating the start position of the turntable of the stamping tool accessory of FIG. 1, wherein the stamp has been applied to the cardstock in the first location of a circular pattern containing three (3) stamps.

The stamping tool accessory 10 may be used in conjunction with a paper crafting stamp platform tool or stamping press, such as the MISTI™ or Tim Holtz® Stamp Platform. As shown in the illustrative embodiments of FIGS. 9 and 10, a stamp platform is a hinged device that opens like a book. Clear craft stamps are stuck on the inside clear front cover (see FIG. 14), inked (see FIG. 15), and then, when the lid is closed the image is stamped on cardstock that is on the base of the stamp platform (see FIGS. 16 and 18). The stamping tool accessory 10 is secured in the base of a stamp platform (see FIGS. 11 and 12) and becomes a rotatable stamping base in the platform. Cardstock is temporarily affixed to the rotatable turntable 12 (see FIG. 13). The user rotates the turntable 12 to desired increments to create repetitious stamped images in a circular format (see e.g., FIG. 22). Throughout this disclosure, the term "stamping platform" will be used synonymously with the term "stamping press".

In the illustrative embodiment, the stamping tool accessory 10 is a rectangular device with a central rotating turntable 12 that fits in the base of craft stamping platforms (see FIGS. 9-12). The stamping tool accessory 10 may be created from paper, cardstock, plastic, foam or other printable substrates. The stamping tool accessory 10 may have multiple layers including a soft foam core that allows improved stamped images, or the stamping tool accessory 10 may be a thin flat one layer device. In the illustrative embodiment, the base 32 of the stamping tool accessory 10 may be formed from a plurality of layers, namely a top layer 34 and a bottom layer 36 (refer to FIGS. 1 and 4-8). The base 32 and turntable 12 of the stamping tool accessory 10 may be formed using various dimensions.

As explained above, the stamping tool accessory 10 has a turntable 12 that rotates in the base 32 of the tool. The turntable 12 may be raised from the top surface of the base 32, or alternatively, may be flush with the top surface of the base 32. In the illustrative embodiment, as best shown in FIG. 1, the turntable 12 is flush or generally flush with the top surface of the base 32. More particularly, referring to FIG. 8, it can be seen that the top layer 34 of the base 32 contains an aperture 38 formed therethrough such that, when the top layer 34 is adhered to the bottom layer 36 of the base 32, a circular recess is formed by the base 32 for accommodating the turntable 12, thereby resulting in the top surface of the turntable 12 being generally flush with the top surface of the base 32. In other words, in the illustrative embodiment, there is a circular cutout area in the central area of the base 32 for accommodating the turntable 12. In the illustrative embodiment, the turntable 12 is circular, and is approximately the same size as the corresponding circular cutout in the base 32. In other alternative embodiments, the turntable 12 may be a multi-sided geometric shape, rather than a circle. The turntable 12 can be manually rotated by a user in the base recess. In the illustrative embodiment, the turntable 12 comprises a gripping tab 14 for facilitating a rotation of the turntable 12 by a user (refer to FIGS. 1, 2, and 8).

In an alternative embodiment, rather than being recessed in the base 32, the turntable 12 of the stamping tool accessory 10 may rest on the top surface of the base 32 such that the turntable 12 protrudes slightly above the top surface of the base 32.

In the illustrative embodiment, the turntable 12 is "free-floating" on the base 32 without any fasteners securing the turntable 12 to the base 32. However, in an alternative embodiment, the center of the turntable 12 may be rotatably attached to the base 32 by a pin, or other suitable attachment means.

As best shown in FIGS. 1 and 2 of the illustrative embodiment, the base 32 and the turntable 12 have distinctive markings that relate to the 360 degree rotation of the turntable 12 within the base 32. Segment marks or indicia 44 indicate the locations of various equally divided segments of a 360 degree circle. There is also a turntable starting indicator 40 (i.e., an ALL START mark or zero mark) in the illustrative embodiment. More particularly, in the illustrative embodiment, the turntable starting indicator 40 is printed or inscribed on the top surface of the base 32 for indicating an initial rotational position of the turntable 12.

In the illustrative embodiment, the segment marks 44 are on the base 32 of the stamping tool accessory 10, around the circumference of the circular turntable 12. In other embodiments, the segment marks 44 may be on the turntable 12 or anywhere on the base 32 of the device 10.

Figure 19:
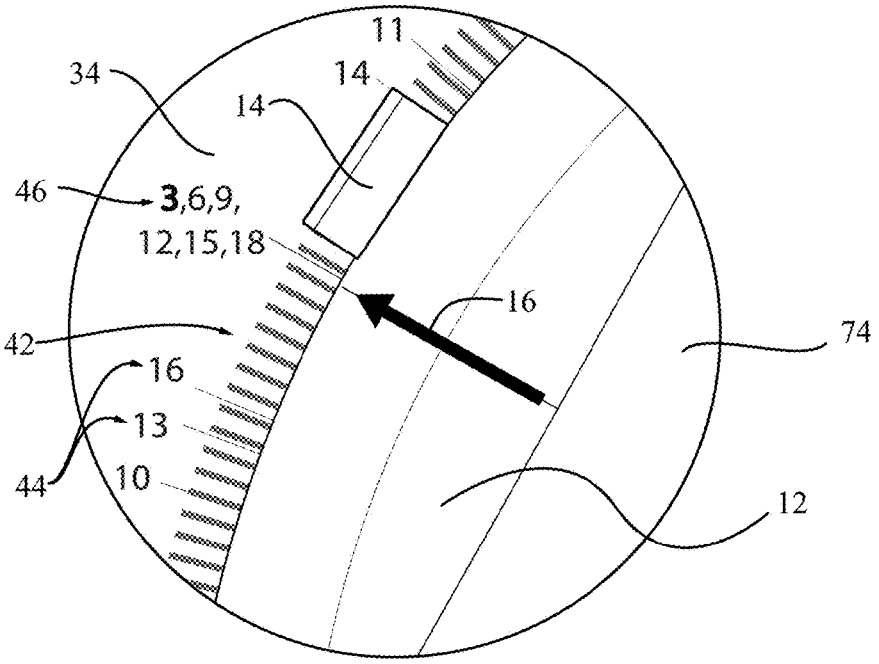
FIG. 19 is an enlarged partial view illustrating the next rotational position of the turntable of the stamping tool accessory illustrated in FIG. 20 (Detail "B")
Figure 20:
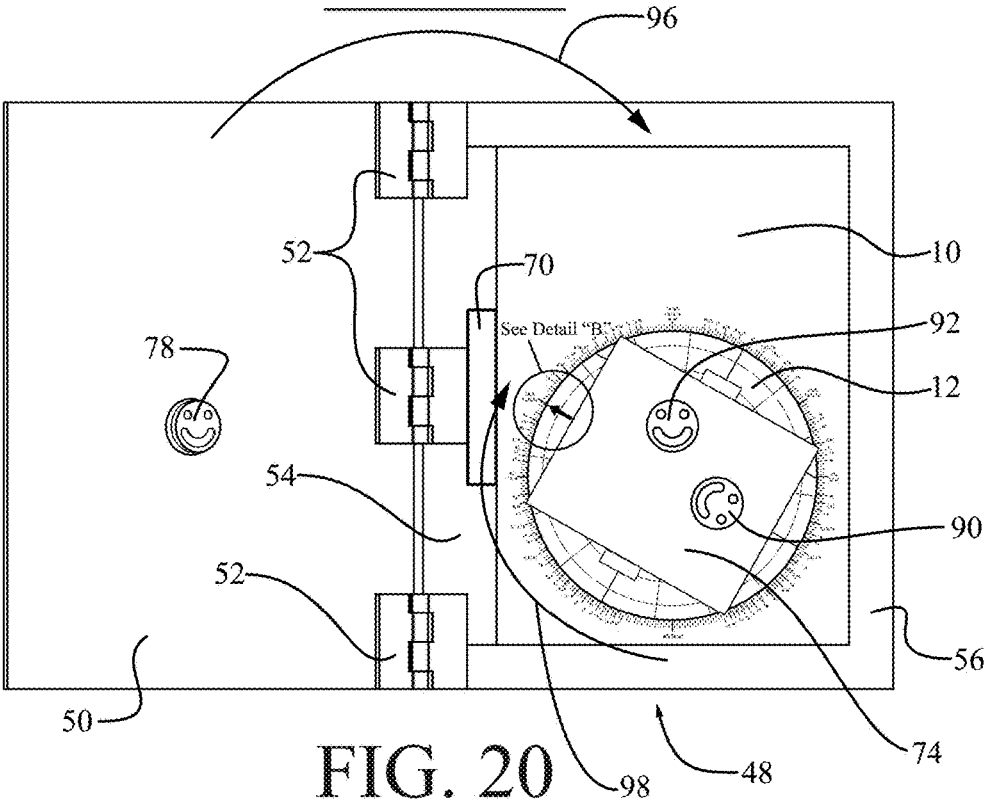
FIG. 20 is a top plan view illustrating the next rotational position of the turntable of the stamping tool accessory of FIG. 1, wherein the stamp has been applied to the cardstock in the second location of the circular pattern containing three (3) stamps.
Figure 21:
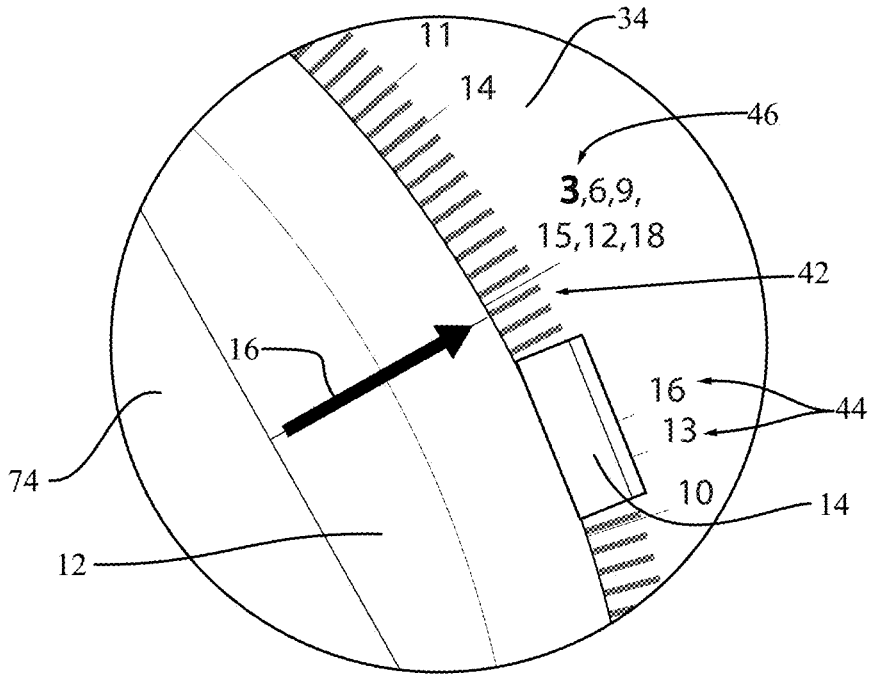
FIG. 21 is an enlarged partial view illustrating the last rotational position of the turntable of the stamping tool accessory illustrated in FIG. 22 (Detail "C")

There are also markings that indicate the position of the turntable 12 relative to the segment marks 44. In the illustrative embodiment, the turntable 12 has a positional indicator in the form of an arrow 16, which acts as a pointer for positioning the turntable 12 to the desired segment marks 44. In the illustrative embodiment, the arrow 16 is printed or inscribed on the turntable 12. The arrow 16 on the turntable 12 is configured to be generally aligned with successive marks of the turntable positioning indicia 44 as the turntable 12 is rotated by a user to the generally equally spaced-apart rotational positions (e.g., as shown in Details "A", "B", and "C" depicted in FIGS. 17, 19, and 21, respectively).

The segment marks 44 on the base 32 reflect many different size segments of the circle's 360 degrees. In the illustrative embodiment, the segment marks 44 are numeric. The segment marks 44 indicate the number of equal segments of a 360 degree circle when the circle is divided into 2, 3, 4, 5, 6, 7, 8, 9, 10, 11, 12, 13, 14, 15, 16, 18, or more equal segments. The segment markings in other embodiments may be numbers, letters, colors or other distinct shapes or icons. Also, in other embodiments, the number of segment markings may vary. In the illustrative embodiment, the starting ones 46 of the segment marks 44 are indicated in bold type (see FIG. 2) such that they are readily visible to the user of the stamping tool accessory 10.

In the illustrative embodiment, the turntable positioning indicia 42, 44 of the stamping tool accessory 10 further comprise 360 degree tick marks 42 allowing the user to rotate the turntable 12 to custom degree positions that may not be marked by segment markings 44. That is, the tick marks 42 allow a user to rotate the turntable 12 to custom degree positions that lie in-between the arcuate segment markings 44.

When rotating the turntable 12 of the stamping tool accessory 10 clockwise from the start position 40, the first instance 46 of each segment mark 44 (which, in the illustrative embodiment, is a number) is differentiated from the other segments using bold type (see FIG. 2). In an alternative embodiment, rather than using bold type, an asterisk may be placed next to the number. This distinction allows the user to easily discover how many segments and number of images fit easily in the design. In yet other alternative embodiments, the differentiated segment marks may be indicated by color or an alternative font appearance.

Now, with reference primarily to FIGS. 1 and 2, the functional features of the turntable 12 will be described. In the illustrative embodiment, the turntable 12 has markings 20, 22, 24, 25, 26, 28, 30 that facilitate the placement of stamps and of cardstock. As best shown in FIG. 2, a horizontal axis 25 and vertical axis 24 are marked on the illustrative turntable 12. In the illustrative embodiment, the horizontal axis 25 and the vertical axis 24 may be printed or inscribed on the turntable 12. The intersection of the horizontal axis 25 and the vertical axis 24 define a central origin at a center point 18 of the turntable 12. Also, in the illustrative embodiment, there are concentric circles 20 with marks in the form of numbers 22 indicating the diameter of the circles 20 as they increase from the central point 18 of the turntable 12 (refer to FIG. 2). These marks 20, 22 allow easy stamp placement in varying circle diameters. In other words, these circumferential markings comprising a plurality of concentric circles 20 with varying diameters facilitate an alignment of stamps in varying diametrical locations. In the illustrative embodiment, there are also radial markings 26, which comprise a plurality of rays emanating the center point 18 of the turntable 12. The radial markings 26 facilitate an alignment of stamps along radii of the turntable 12. In addition, in the illustrative embodiment, the turntable 12 further comprises a plurality of horizontal and vertical substrate positioning lines 28, 30 printed or inscribed thereon. The plurality of horizontal and vertical substrate positioning lines 28, 30 are configured to facilitate a placement of the substrate (e.g., the cardstock) on the turntable 12 by a user. For example, in the illustrative embodiment, there may be marks that facilitate placement of A2 sized (4.25×5.5 inch) cardstock in a central position of the turntable 12. Also, there may be horizontal and vertical lines 2.125 and 2.75 inches from the center point 18 to further facilitate cardstock placement. In larger embodiments of the turntable 12, additional spacing marks may be added.

In the illustrative embodiment, the turntable 12 and base 32 of the stamping tool accessory 10 may have a generally smooth and level work surface. In the illustrative embodiment, the turntable 12 and the base 32 are approximately the same thickness, and the junction of the turntable 12 and base 32 are close enough that the small space does not affect the quality of the stamped image. In other alternative embodiments, the turntable 12 may rest on top of the base 32 creating an uneven surface.

In the illustrative embodiment, the entire surface of the stamping tool accessory 10 may be covered in a wipeable coating that is not affected by alcohol, water, or stamp cleaners. The markings on the tool may be underneath the wipeable surface. In the illustrative embodiment, there is a bottom layer 36 under the entire dimension of the tool that stabilizes the base 32 and keeps the circular turntable 12 from falling out of the base 32 (see FIG. 8).

In one or more alternative embodiments, the stamping tool accessory 10 may have an extended frame that allows stamping images beyond the size of the turntable portion 12 of the tool.

Also, in one or more embodiments, the stamping tool accessory 10 may include a clear acetate sheet with the same markings as the rotating turntable 12. The clear sheet markings can be used to assist placement of stamps when cardstock is affixed to the turntable 12. This allows users to leave the cardstock in place while using the placement markings on the turntable 12.

Figure 9:
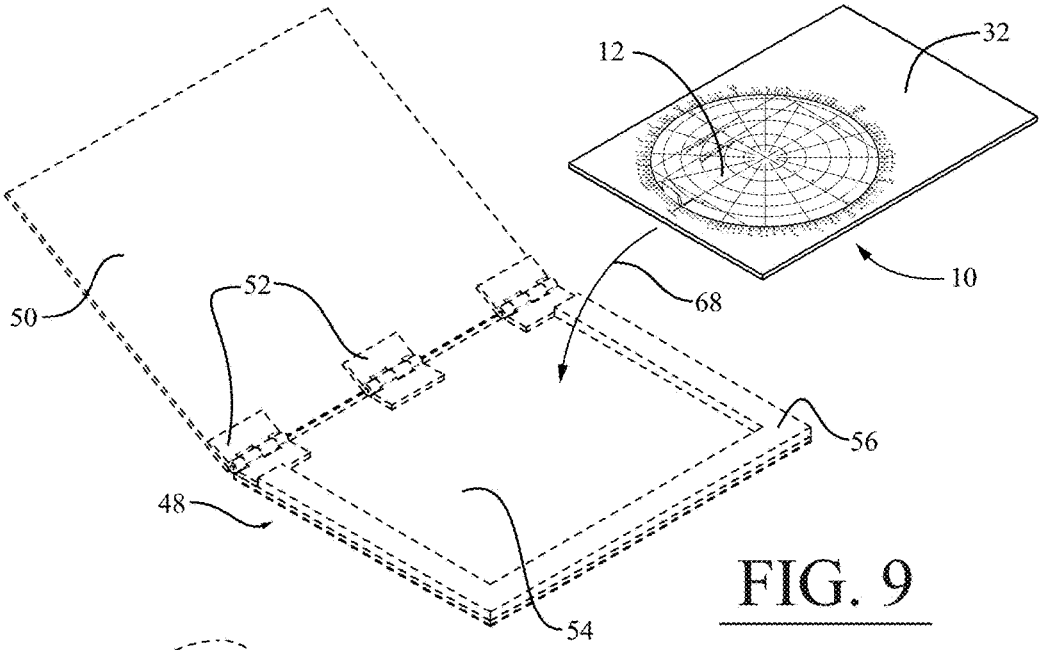
FIG. 9 is a perspective view illustrating the stamping tool accessory of FIG. 1 being inserted into a first type of stamping platform.
Figure 10:
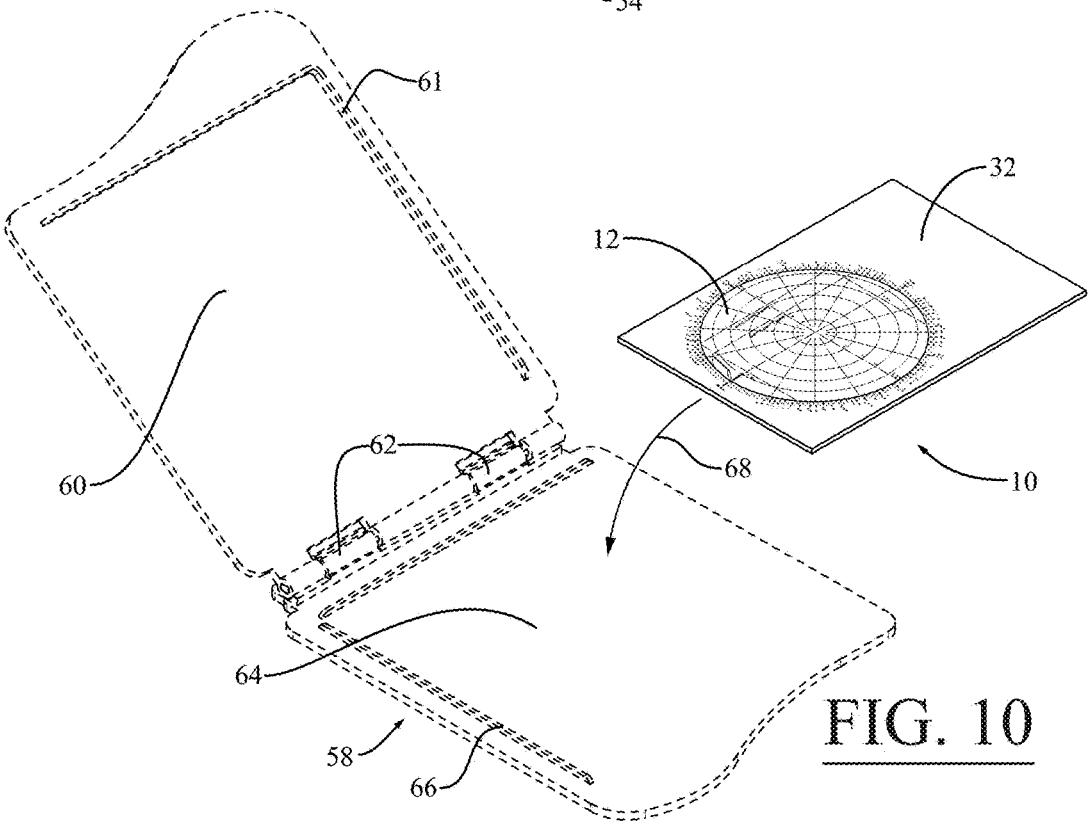
FIG. 10 is a perspective view illustrating the stamping tool accessory of FIG. 1 being inserted into a second type of stamping platform.
Figure 11:
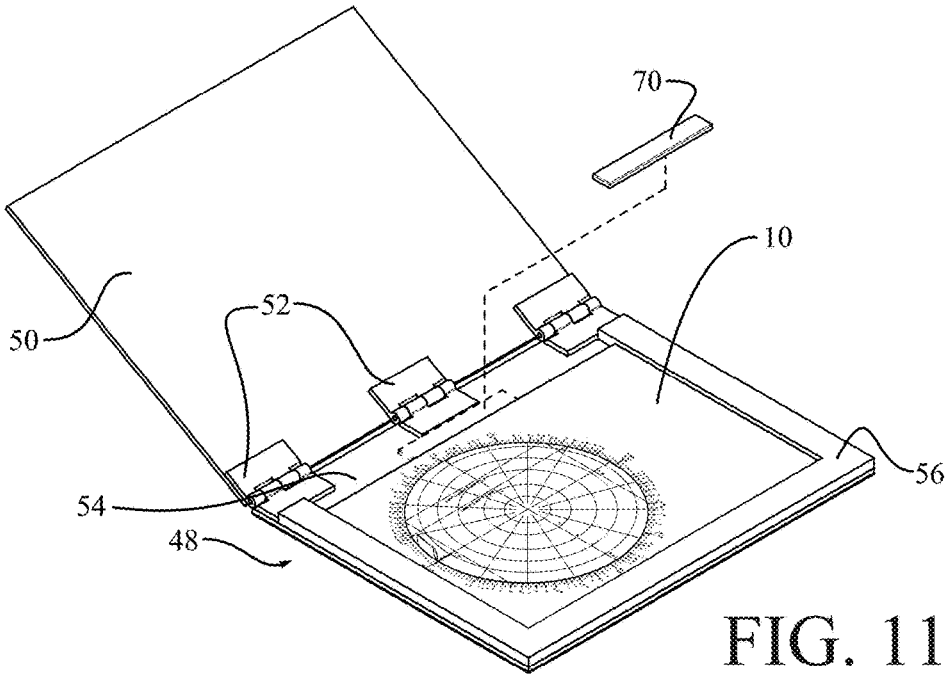
FIG. 11 is a perspective view illustrating a first type of attachment means for attaching the stamping tool accessory of FIG. 1 to a stamping platform.
Figure 12:
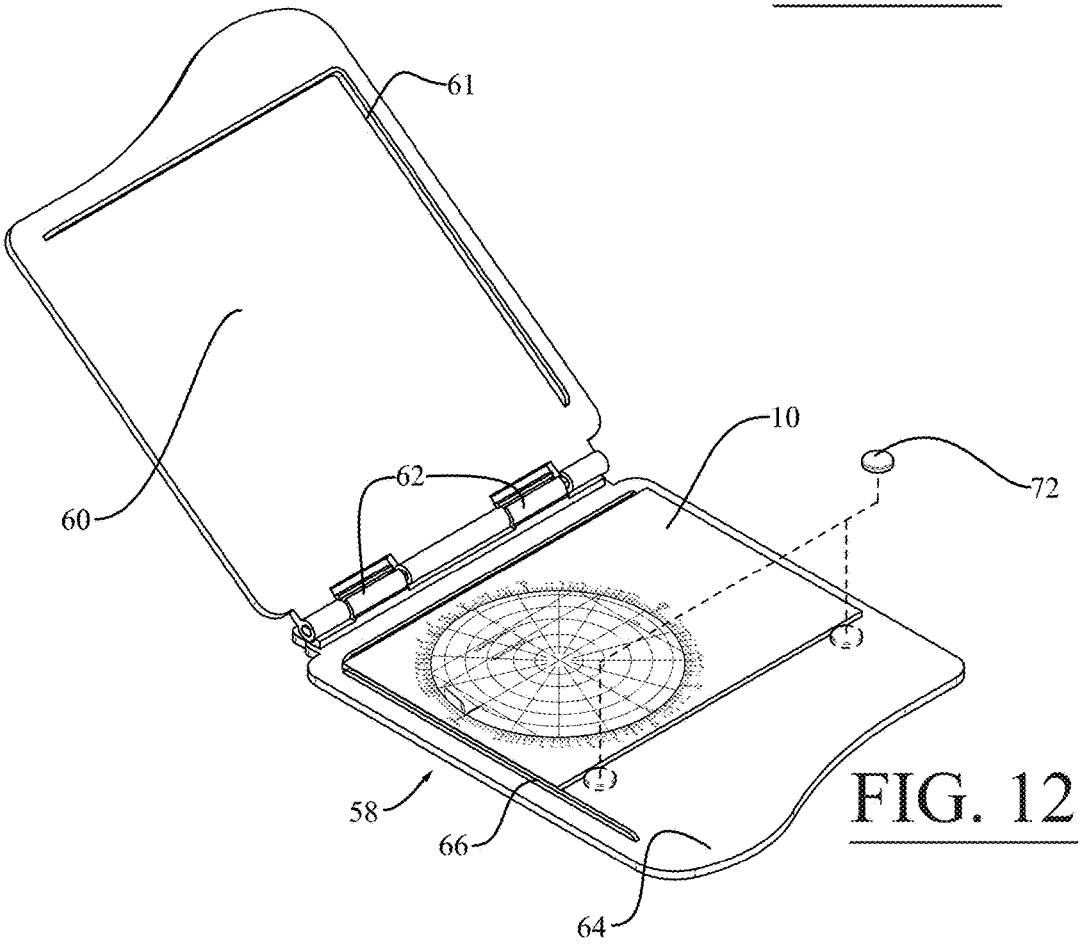
FIG. 12 is a perspective view illustrating a second type of attachment means for attaching the stamping tool accessory of FIG. 1 to a stamping platform.
Figure 13:
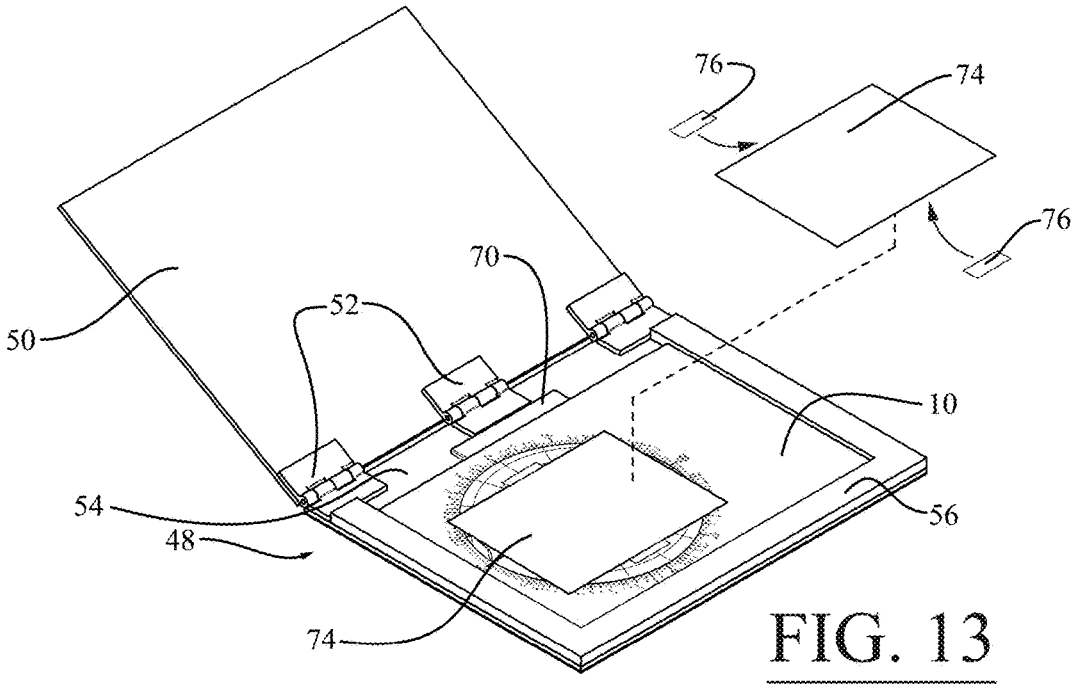
FIG. 13 is a perspective view illustrating the manner in which a piece of cardstock is removably attached to the turntable of the stamping tool accessory of FIG. 1.

Next, with reference to FIGS. 9-22, the manner in which the stamping tool accessory 10 is used with a stamping platform 48 (or stamping platform 58) will be described. In the illustrative embodiment, referring initially to FIGS. 9 and 11, the stamping tool accessory 10 may be used with a stamping platform 48 that includes a base portion 54 configured to receive a substrate on which a stamp is to be applied, and a cover portion 50 hingedly coupled to the base portion 54. The cover portion 50 of the stamping platform 48 is configured to accommodate the stamp removably attached thereto. As shown in FIGS. 9 and 11, the cover portion 50 of the stamping platform 48 is pivotally attached the base portion 54 by hinges 52. In FIGS. 10 and 12, a different type of stamping platform 58 is depicted. Like the stamping platform 48 of FIGS. 9 and 11, the stamping platform 58 of FIGS. 10 and 12 comprises a cover portion 60 pivotally coupled to a base portion 64 by hinges 62.

Initially, the stamping tool accessory 10 is placed in the base portion 54, 64 of the stamping platform 48, 58 (as shown diagrammatically by the curved arrow 68 in FIGS. 9 and 10). If desired, various types of attachment devices may be used to hold the stamping tool accessory 10 in place within the platform base portion 54, 64. For example, as shown in FIG. 11, a bar magnet 70 may be used to secure the stamping tool accessory 10 within the platform base portion 54 (the base portion 54 is formed from a magnetic or ferrous material). As another example, as shown in FIG. 12, circular magnets 72 may be used to secure the stamping tool accessory 10 within the platform base portion 64 (the base portion 64 is formed from a magnetic or ferrous material). Alternatively, one or more pieces of tape or an adhesive may be used to secure the tool in place. Also, the peripheral protruding rim 56 on the base portion 54 of the stamping platform 48 helps to maintain the stamping tool accessory 10 in place (i.e., the edges of the base 32 of the stamping tool accessory 10 may abut the peripheral protruding rim 56 of the stamping platform 48). Similarly, the L-shaped protrusion 61 on the cover portion 60 of the stamping platform 58 and the L-shaped protrusion 66 on the base portion 64 helps to maintain the stamping tool accessory 10 in place (i.e., the edges of the base 32 of the stamping tool accessory 10 may abut one or both L-shaped protrusions 61, 66 of the stamping platform 58).

Figure 14:
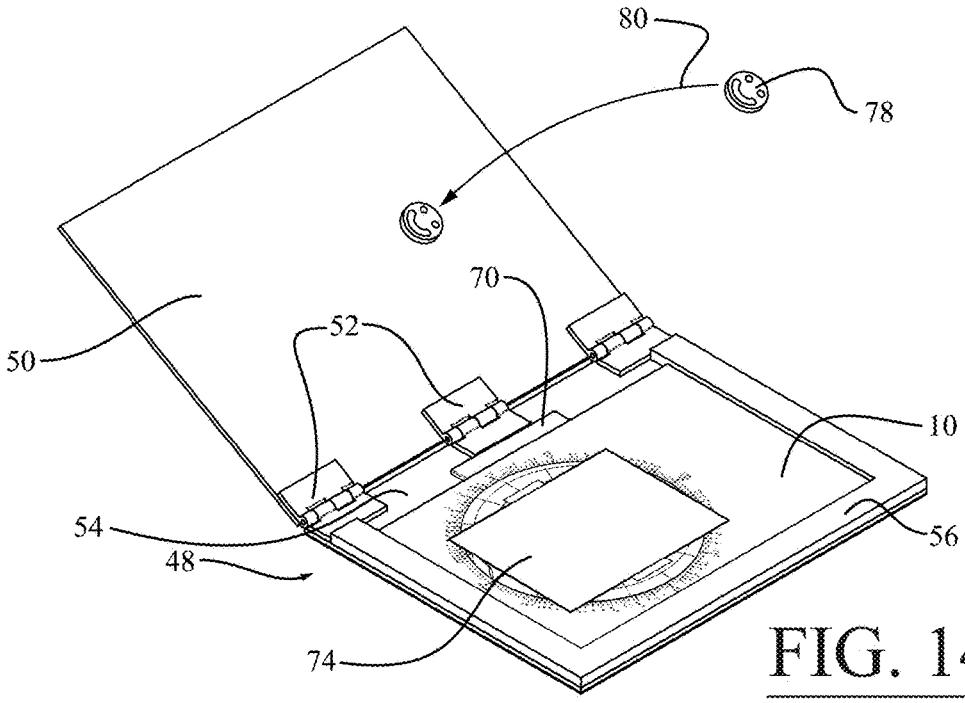
FIG. 14 is a perspective view illustrating the manner in which a stamp is attached to the cover portion of the stamping platform.
Figure 17:
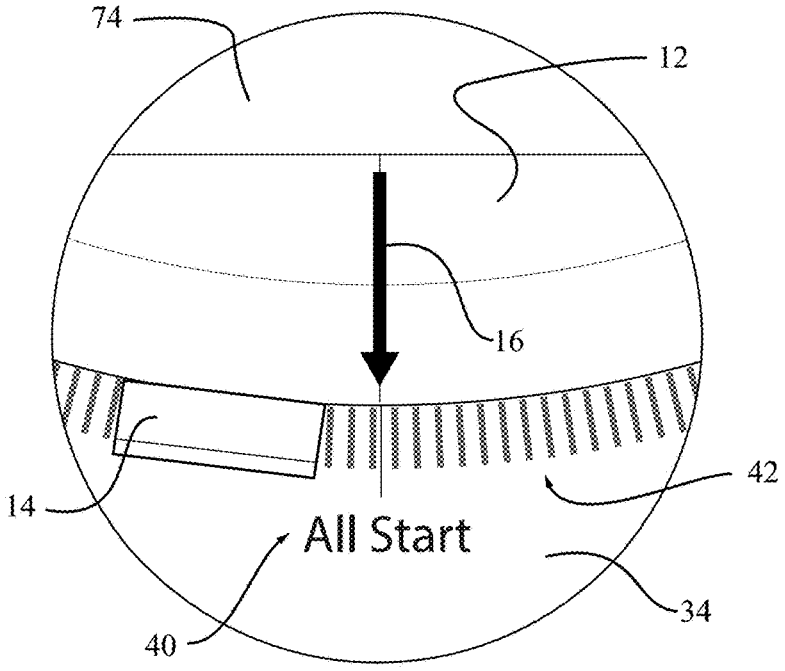
FIG. 17 is an enlarged partial view illustrating the start position of the turntable of the stamping tool accessory illustrated in FIG. 18 (Detail "A")
Figure 22:
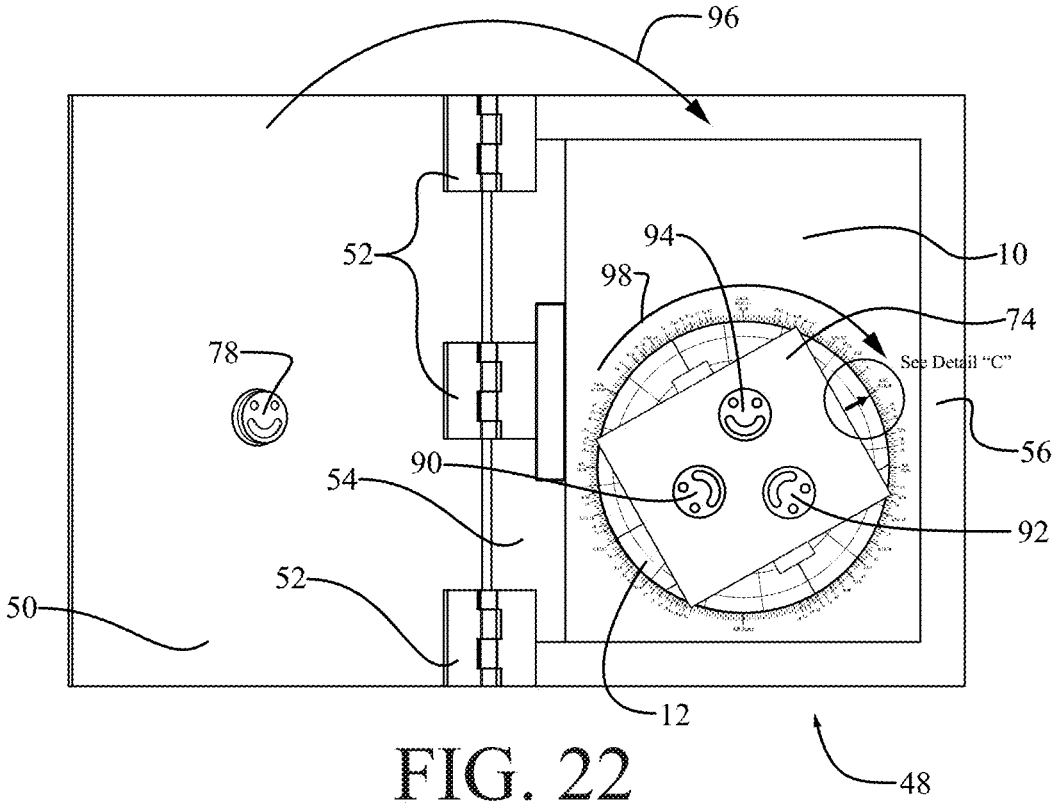
FIG. 22 is a top plan view illustrating the last rotational position of the turntable of the stamping tool accessory of FIG. 1, wherein the stamp has been applied to the cardstock in the final third location of the circular pattern containing three (3) stamps.

Once the stamping tool accessory 10 is fixed in place within the base portion 54 of the stamping platform 48, the turntable 12 is rotated so the stamping tool accessory 10 is at the start position (i.e., the FIG. 17 position). Then, a stamp image is chosen for the design. As shown in FIG. 14, a stamp 78 is positioned and stuck on the inside surface of the cover portion 50 of the stamping platform 48 (as shown diagrammatically by the curved arrow 80 in FIG. 14). A piece of cardstock 74 is temporarily affixed to the turntable 12 of the stamping tool accessory 10 (e.g., by using pieces of tape 76). This piece of cardstock 74 will be the surface for the finished stamped design. When the stamp and cardstock alignment is as desired, the stamping can begin. Next, the user applies ink using an ink pad 82 to the stamp 78 on the inside surface of the cover portion 50 of the stamping platform 48 (as shown diagrammatically by the curved arrow 84 in FIG. 15), and then closes the lid 50 of the stamping platform 48 (as shown diagrammatically by the curved arrow 86 in FIG. 16). The first image 90 will stamp on the cardstock 74 that is attached to the turntable 12 of the stamping tool accessory 10 (see FIG. 18). Then, the lid 50 of the stamping platform 48 is lifted (as shown diagrammatically by the curved arrow 88 in FIG. 18). Next, the user decides how many images he or she desires to stamp in a circular pattern. Once the number of images is determined, the turntable 12 of the stamping tool accessory 10 is rotated clockwise (as shown diagrammatically by the curved arrow 98 in FIG. 20) so the turntable pointer 16 lines up with the first instance of the segment mark 46 that corresponds to the number of images desired (e.g., the segment mark "3" in FIG. 19 corresponding to the creation of three (3) images in a circular pattern). The stamp 78 remains in place on the lid 50 of the stamping platform 48. The stamp 78 is reinked and the stamp platform lid 50 is closed again (as shown diagrammatically by the curved arrow 96 in FIG. 20). A second image 92 is stamped on the cardstock 74 affixed to the turntable 12 of the stamping tool accessory 10. This process is repeated, rotating the turntable 12 clockwise 360 degrees, stopping at each segment mark that corresponds to the number of desired images in the design (e.g., in the illustrative case, a total of three (3) images). As shown in FIG. 22, after the turntable pointer 16 is lined up with the next instance of the segment mark 46 in FIG. 21, a final third image 94 is stamped on the cardstock 74 that is affixed to the turntable 12 of the stamping tool accessory 10. Once the turntable pointer 16 of the stamping tool accessory 10 is ready to be returned to the starting position, the desired number of images 90, 92, 94 will be stamped evenly around a center point. If desired, multiple stamps can be used to create intricate designs by layering the stamp images or building out intricate designs.

In one or more embodiments, differentiated segment marks may be used. The differentiated segment marks allow the user to easily decide how many segments are possible in a design. The turntable 12 of the stamping tool accessory 10 is set to the start position (i.e., the FIG. 17 position) and the first image is stamped. Then, the stamping platform 48 can be partially opened, the stamp platform lid 50 with the still attached stamp is hovered above the cardstock on the turntable 12. The turntable 12 is rotated clockwise until the stamped image on the cardstock and the stamp on the platform align as desired. Then, the stamp platform lid 50 is opened completely and the turntable 12 is moved so the pointer 16 is in line with the nearest differentiated segment mark (e.g., the segment mark in bold type). This will indicate the segment marks to be used in the design. In other embodiments, the differentiated segment marks can be designed with an asterisk, rather than being designated using bold type.

Advantageously, there are a myriad of different design options that are possible with the stamping tool accessory 10. For example, the stamping tool accessory 10 may be used to create the exemplary circular stamping patterns 100, 102, 104 depicted in FIGS. 23, 24, and 25, respectively. As other examples, stars or bursts may be created using the stamping tool accessory 10 by aligning a stamp from the center of the turntable 12 along one of the radial markings 26 on the turntable 12. Once the stamp is aligned along one of the radial markings 26, repeatedly stamping using the stamping tool accessory 10 will produce a star, flower or sunburst like pattern.

As yet other examples of designs that may be created using stamping tool accessory 10, wreath or circles may be created by aligning a stamp along the concentric circle marks 20 on the turntable 12. Once the stamp is aligned along one of the concentric circle marks 20, repeatedly stamping using the stamping tool accessory 10 will produce a circular pattern like a wreath or donut shape.

Figure 23:
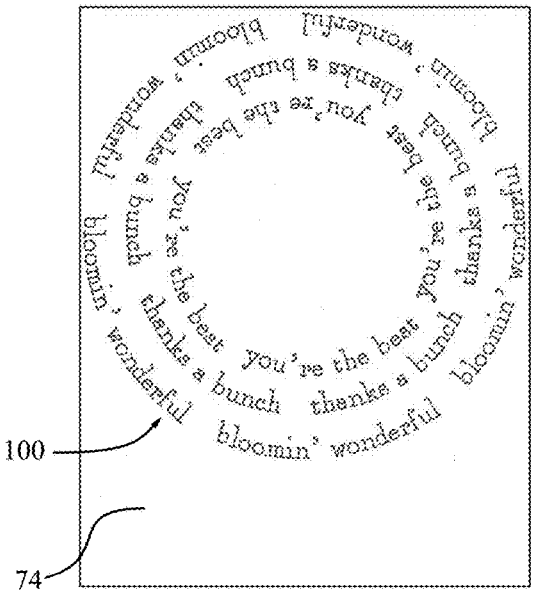
FIG. 23 is a first exemplary circular stamping pattern created using the stamping tool accessory of FIG. 1.
Figure 24:
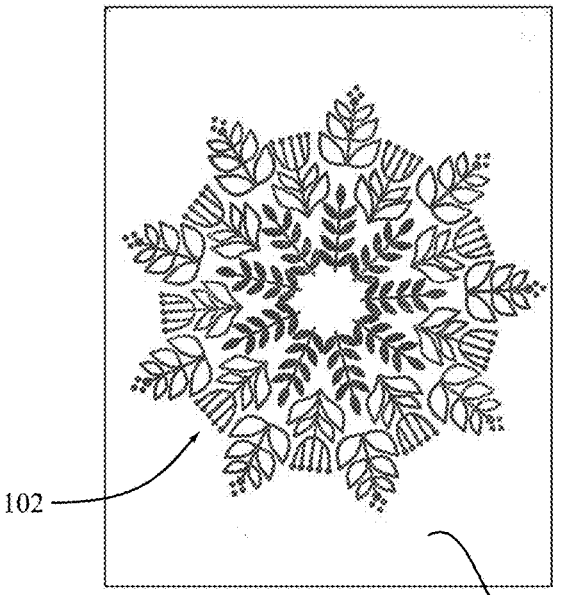
FIG. 24 is a second exemplary circular stamping pattern created using the stamping tool accessory of FIG. 1.
Figure 25:
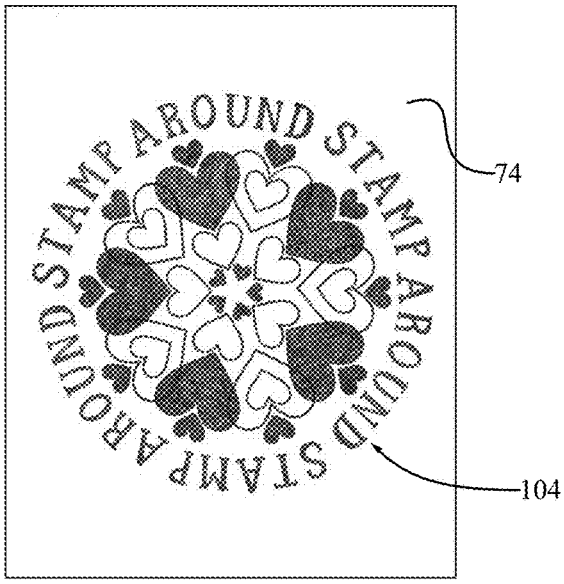
FIG. 25 is a third exemplary circular stamping pattern created using the stamping tool accessory of FIG. 1.

As yet other examples of designs that may be created using stamping tool accessory 10, sentiment circles may be created by aligning sentiment stamps (i.e., word stamps that are in sentence form) so that they curve with the concentric circle marks 20 on the turntable 12. Once the stamp is aligned along one of concentric circle marks 20, repeatedly stamping using the stamping tool accessory 10 will produce a complete circle of words (e.g., as shown in FIG. 23).

As still other examples of designs that may be created using stamping tool accessory 10, different geometric shapes (e.g., polygonal shapes) may be created by aligning a straight stamp with the stamp touching portions of one of the concentric circles 20 on the turntable 12. Once the stamp is aligned with the stamp touching portions of one of the concentric circles 20, repeatedly stamping can produce geometric designs.

It is readily apparent that the aforedescribed stamping tool accessory 10 and stamping tool assembly including the same offer numerous advantages. First, stamping tool accessory 10 is capable of greatly facilitating the stamping of multiple images in a generally circular pattern. Secondly, the stamping tool accessory 10 can be used to create a myriad of different stamping patterns. Finally, the stamping tool assembly described above, which utilizes the stamping tool accessory 10, significantly enhances the functionality of stamping platforms 48, 58.

Advantageously, the aforedescribed stamping tool accessory 10 provides a method for repeatedly stamping an image at many different numbers of even or odd intervals around a center point. The stamping tool accessory 10 allows crafters to easily stamp circular wreaths, sentiments, stars, mandalas and geometric and other circular designs with any number of image repetitions, and with any degree of separation between the images without premeasuring.

Also, advantageously, the aforedescribed stamping tool accessory 10 is a stamping tool that works with crafting stamp press tools. The stamping tool accessory 10 comes in varying sizes to fit in the various size stamp presses. As explained above, the stamping tool accessory 10 is an insert that is placed in the bottom base of a stamp press. Cardstock attached to the stamping tool accessory 10 can be rotated to precise positions to create circular stamping patterns. The markings or indicia 42, 44 of the stamping tool accessory 10 guide the user to rotate cardstock to specific degrees of rotation based on how many times an image will be stamped in the 360 circular design.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A stamping tool accessory, comprising:

a base configured to be removably attached to a base portion of a stamping platform; and a turntable rotatable relative to the base, the turntable configured to receive a substrate on which a stamp is to be applied;

wherein at least one of the base and the turntable comprises turntable positioning indicia configured to indicate generally equally spaced-apart rotational positions of the turntable for stamping multiple images in a generally circular pattern.

2. The stamping tool accessory according to claim 1, wherein the base forms a circular recess for accommodating the turntable such that a top surface of the turntable is generally flush with a top surface of the base.

3. The stamping tool accessory according to claim 1, wherein the turntable rests on a top surface of the base such that the turntable protrudes slightly above the top surface of the base.

4. The stamping tool accessory according to claim 1, wherein the turntable positioning indicia are printed or inscribed on a top surface of the base adjacent to the outer periphery of the turntable, the turntable positioning indicia comprising a plurality of sets of arcuate segment markings generally equally spaced about the outer periphery of the turntable such that a 360 degree circle is divided into a plurality of generally equal arcuate sections.

5. The stamping tool accessory according to claim 4, wherein at least some of the plurality of sets of arcuate segment markings comprise numbers, letters, or other symbols for designating the generally equally spaced-apart rotational positions of the turntable.

6. The stamping tool accessory according to claim 4, wherein the turntable positioning indicia further comprise tick marks for allowing a user to rotate the turntable to custom degree positions that lie in-between the arcuate segment markings.

7. The stamping tool accessory according to claim 1, wherein the top surface of the base further comprises a start mark or zero mark printed or inscribed thereon for indicating an initial rotational position of the turntable.

8. The stamping tool accessory according to claim 1, wherein the turntable comprises a gripping tab for facilitating a rotation of the turntable by a user.

9. The stamping tool accessory according to claim 1, wherein the turntable comprises a positional marking printed or inscribed thereon, the positional marking configured to be generally aligned with successive marks of the turntable positioning indicia as the turntable is rotated by a user to the generally equally spaced-apart rotational positions.

10. The stamping tool accessory according to claim 1, wherein the turntable comprises a horizontal axis and vertical axis printed or inscribed thereon, the intersection of the horizontal axis and vertical axis defining a central origin at a center point of the turntable.

11. The stamping tool accessory according to claim 1, wherein the turntable comprises a plurality of circumferential markings, the circumferential markings comprising a plurality of concentric circles with varying diameters, the circumferential markings facilitating an alignment of stamps in varying diametrical locations.

12. The stamping tool accessory according to claim 1, wherein the turntable comprises a plurality of radial markings, the radial markings comprising a plurality of rays emanating a center point of the turntable, the radial markings facilitating an alignment of stamps along radii of the turntable.

13. The stamping tool accessory according to claim 1, wherein the turntable comprises a plurality of horizontal and vertical substrate positioning lines printed or inscribed thereon, the plurality of horizontal and vertical substrate positioning lines configured to facilitate a placement of the substrate on the turntable by a user.

14. A stamping tool assembly, comprising:

a stamping platform that includes:

a base portion configured to receive a substrate on which a stamp is to be applied; and a cover portion hingedly coupled to the base portion, the cover portion configured to accommodate the stamp removably attached thereto; and a stamping tool accessory that includes:

a base configured to be removably attached to the base portion of the stamping platform; and a turntable rotatable relative to the base, the turntable configured to receive the substrate on which the stamp is to be applied;

wherein at least one of the base and the turntable comprises turntable positioning indicia configured to indicate generally equally spaced-apart rotational positions of the turntable for stamping multiple images in a generally circular pattern.

15. The stamping tool assembly according to claim 14, wherein the turntable positioning indicia are printed or inscribed on a top surface of the base adjacent to the outer periphery of the turntable, the turntable positioning indicia comprising a plurality of sets of arcuate segment markings generally equally spaced about the outer periphery of the turntable such that a 360 degree circle is divided into a plurality of generally equal arcuate sections.

16. The stamping tool assembly according to claim 15, wherein at least some of the plurality of sets of arcuate segment markings comprise numbers, letters, or other symbols for designating the equally spaced-apart rotational positions of the turntable.

17. The stamping tool assembly according to claim 14, wherein the top surface of the base further comprises a start mark or zero mark printed or inscribed thereon for indicating an initial rotational position of the turntable.

18. The stamping tool assembly according to claim 14, wherein the turntable comprises a gripping tab for facilitating a rotation of the turntable by a user.

19. The stamping tool assembly according to claim 14, wherein the turntable comprises a plurality of circumferential markings, the circumferential markings comprising a plurality of concentric circles with varying diameters, the circumferential markings facilitating an alignment of stamps in varying diametrical locations.

20. The stamping tool assembly according to claim 14, wherein the turntable comprises a plurality of radial markings, the radial markings comprising a plurality of rays emanating a center point of the turntable, the radial markings facilitating an alignment of stamps along radii of the turntable.

* * * * *